United States Patent [19]

Compagnucci

[11] Patent Number: 4,807,766

[45] Date of Patent: Feb. 28, 1989

[54] DOMESTIC CLOTHES DRYING RACK

[76] Inventor: Rossano Compagnucci, Via Flaminia II, Osimo (AN), Italy

[21] Appl. No.: 115,926

[22] Filed: Nov. 2, 1987

[30] Foreign Application Priority Data

Nov. 17, 1986 [IT] Italy ..... 20607/86[U]

[51] Int. Cl.[4] ..... A47F 5/00

[52] U.S. Cl. ..... 211/198; 248/166

[58] Field of Search ..... 211/198, 195, 181; 248/166, 125

[56] References Cited

U.S. PATENT DOCUMENTS 288,645 11/1883 Long ..... 211/198
922,803 5/1909 McIlvain et al. ..... 211/198
1,981,268 11/1934 Heiser ..... 211/198
2,274,772 3/1942 Bitney ..... 211/198

FOREIGN PATENT DOCUMENTS 2925701 1/1980 Fed. Rep. of Germany ..... 211/198
1284663 1/1962 France ..... 211/198
1406815 6/1965 France ..... 211/198

*Primary Examiner*—Robert W. Gibson, Jr.
*Attorney, Agent, or Firm*—Leonard Bloom

[57] ABSTRACT

This invention concerns a domestic clothes drying rack, of the trestle variety, equipped with a peg tray, with centrally hinged connecting rods between the various arms of the clothes rack that permit said articulated arms to be opened or closed rapidly and easily.

13 Claims, 3 Drawing Sheets

DOMESTIC CLOTHES DRYING RACK

This invention concerns a domestic clothes drying rack, of the trestle variety, equipped with a peg tray, with centrally hinged connecting rods between the various arms of the clothes rack that permit said articulated arms to be opened or closed rapidly and easily.

As is known, domestic clothes drying racks are generally made up of several arms, each of which is usually composed of a series of thin, round rods or lines, parallel to one another, and secured at either end to an external supporting frame which is almost always made from pressed tubular section.

The structure of domestic clothes racks, regardless of the various, sometimes considerable, differences there may be between one model and another, always comprises an articulated structure, the configuration thereof being variable, made up of several arms hinged together in such a way that when not in use the clothes rack can be kept closed in a contracted, flattened position, taking up very little room. It may therefore be stored in places of limited dimensions, this requirement being dictated above all by the shortage of space which characterises the average dwelling nowadays.

In order for the household item in question to attain the necessary degree of practicality, it is obvious that such articulated arm must be easy to close or open.

The currently known clothes rack, of the trestle variety, generally comprises two identical quadrangular frames, hinged together around a horizontal axis on one of their two short sides and constrained by a pair of lateral connecting rods which prevent the two aforesaid frames from fully opening so that the short sides of the frames, opposite their hinged counterparts, rest on the ground.

Each of the abovementioned connecting rods is permanently anchored at one of its ends to one of the two quadrangular frames, while at the other end there is a hooked section which hooks up with a corresponding device provided for the purpose on the other quadrangular frame; the same goes for the connecting rods or struts used to support any grids that may be hinged to the two abovementioned quadrangular frames which act mainly as a supporting and stabilising structure on the ground for the clothes rack.

This means that each time the clothes rack is opened or closed the user has to unhook, one at a time and one after the other, the connecting and supporting rods of the various arms that go to make up the clothes rack.

Given the obvious inconvenience and awkwardness of the repetitive manual operations just described, it has been thought fit to create a new model of clothes rack which is not penalised by the inconvenience mentioned above; this is due to the use of centrally hinged connecting and supporting rods between the various arms, said rods being permanently fixed at both ends to the two elements which they connect.

The central joint in said rods is formed by means of a new, special hinge characterised by a knee-like movement arising from the fact that the two centrally anchored parts can rotate between two end positions: one corresponds to the perfect alignment of the two parts, exactly opposite one another in relation to the central fixing pin; the other is obtained by moving both parts towards one another so that they rest side by side and parallel, having both rotated through an angle of 90° around their fulcrum, having started from the position previously described.

As a result of the use of the abovementioned rods, the clothes rack according to the invention can be opened easily and rapidly, without awkward, inconvenient manual intervention on the part of the user who merely has to open the various articulated arms which spontaneously block in the position in which the clothes rack is used, being automatically held in place by the centrally articulated rods which reach their maximum opening span at this point.

So as to make sure that accidental blows to the central articulation joint of the rods does not cause the latter to involuntarily close, the abovementioned hinge has a special internal articulation joint which guarantees the stability of the fully opened position of the selfsame hinge, so that rotation in order to close can only take place after the two perfectly aligned pivoting parts have been slightly parted.

The clothes rack according to the invention is also characterised by the fact that it is equipped with a central peg tray which is fixed transversally to two opposed plates positioned on either side of the clothes rack. On the outer side of said plates are the anchoring holes for the four arms which make up the design according to the invention: two central internal arms which act above all as a supporting and stabilising structure, resting on the ground, and two external upward swinging arms which can be blocked in a horizontal or subhorizontal position that act above all as areas from which to hang washing.

Each of the abovementioned four arms consists of a grid made up of a supporting frame bent in the shape of a portal, the vertical sides thereof bearing an end section that is bent inwards at right angles and is housed on the outside of the two abovementioned lateral support pltes, inside recesses wherein said end sections may pivot.

For further clarity of explanation the description of the invention proceeds with reference to the enclosed drawings, reproduced for illustrative and not restrictive purposes, wherein.

Figure 1:
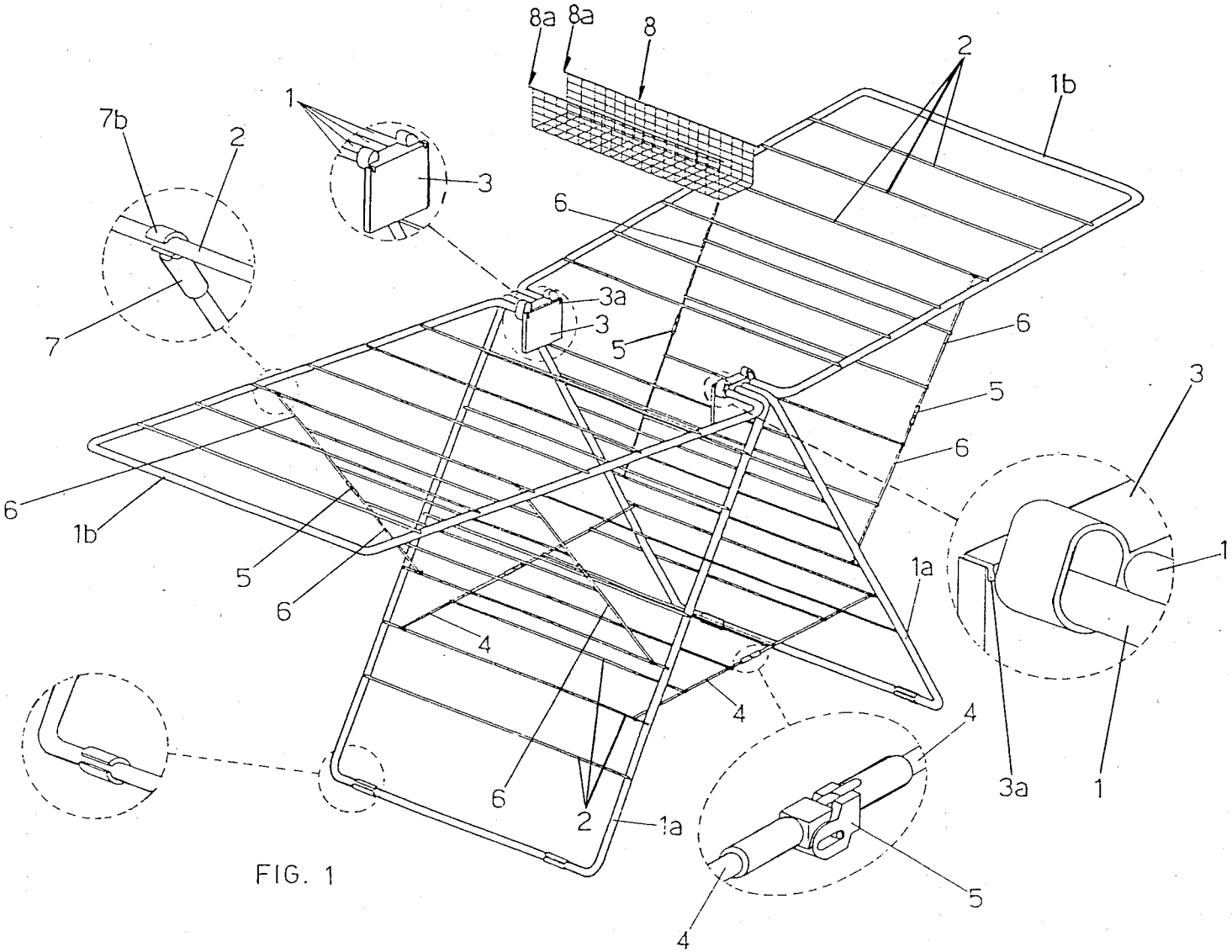
FIG. 1 is an axonometric representation of the clothes rack according to the invention in the open position for normal use.
Figures 2, 3, 5:
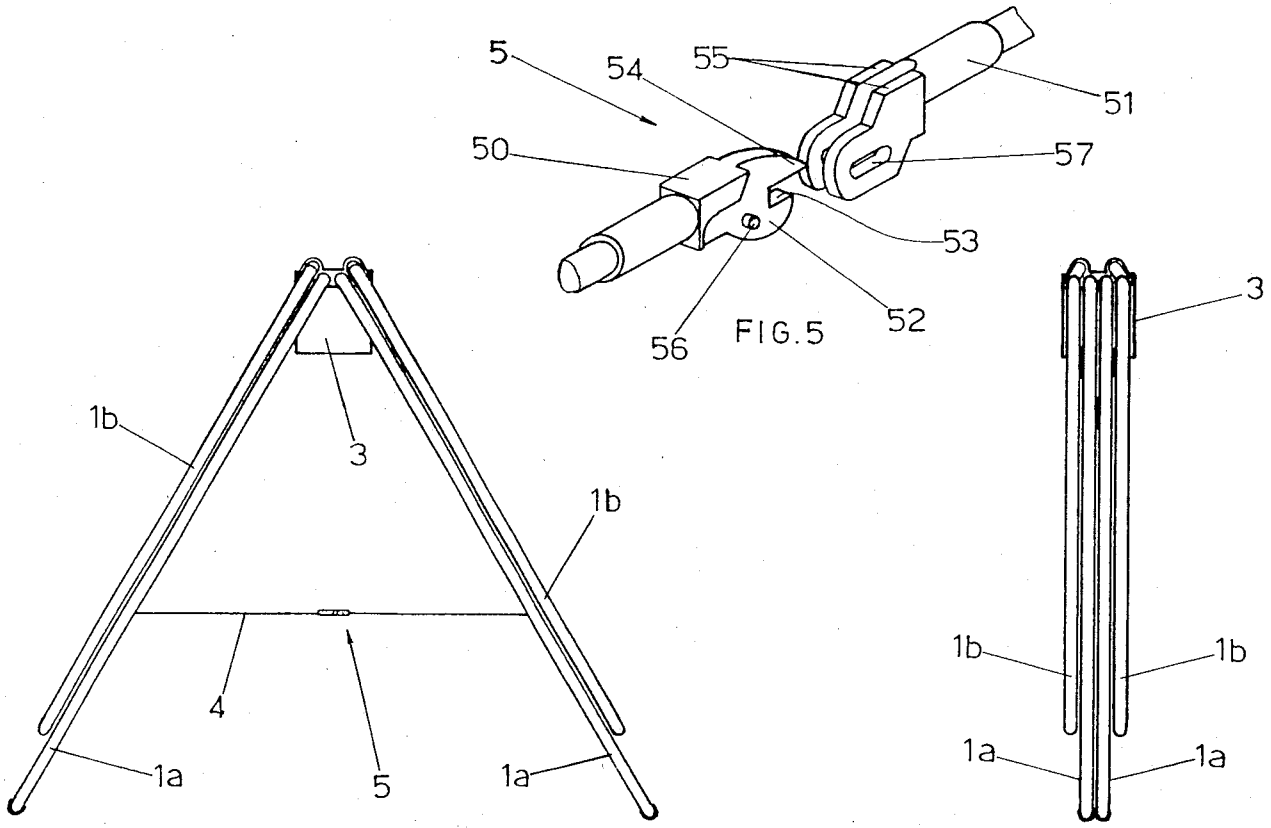
FIG. 2 is a view in side elevation of the clothes rack according to the invention in the semi-open position.
FIG. 3 is a view in side elevation of the clothes rack in the closed position.
FIG. 5 is an axonometric representation of the new hinge used on the clothes rack as per the invention.

With reference to the abovementioned FIGS. 1, 2 and 3, the clothes rack in question, in a preferred embodiment, comprises four arms which are articulated so that they open out like a fan, two of which (1*a*) form a trestle which acts above all as the supporting and stabilising structure, resting on the ground, while the other two (1*b*) act exclusively as areas from which washing may be hung.

Each arm is made up of a portal-shaped supporting frame made from a tubular element bent into a U-shape with several transversal spokes (2) welded thereto, spaced at regular intervals on top of the vertical supports of the abovementioned frame.

The two parallel vertical supports of each frame terminate in two opposed co-axial short sections (1), bent inwards at right angles, which act as pivoting pins for the rotation around a horizontal axis of the respective portal.

In fact, said end sections (1) are housed within separate holding and guiding seats, positioned side by side on the external faces of two identical opposed and aligned plates (3); these plates act as sole supporting, connecting and hinging element for the four arms that are articulated in a fan-like fashion.

As demonstrated in FIG. 3, in the fully closed position, the clothes rack according to the invention shows the four arms exactly side by side and parallel to one another, with the pair (1*a*) that goes to form the two legs of of the trestle in the centre, and the other pair of arms (1*b*) on the outside and on opposite sides in relation to arms (1*a*).

In order to completely open the clothes rack, as illustrated in FIG. 1, an intermediate semi-open configuration is passed through, illustrated in FIG. 2, where arms (1*a*) are open to the maximum degree permitted by the pair of centrally joined lateral rods (4), each of which is permanently hinged at its ends to two transversal coplanate spokes (2), the latter being welded onto the outside of the vertical supports of the frame (1*a*).

Each rod (4) has a new, original hinge (5) at the centre, articulated in the manner of a knee so as to permit a maximum opening angle of 180° and a minimum closing angle of 0°.

This hinge (5) is also characterised by the fact that it can be closed after assuming the abovementioned maximum opening position only after the two hinge elements have been slightly moved apart from one another, thus eliminating the possibility of its closing if accidentally knocked.

This same hinge (5) is used in the lateral pairs of jointed struts (6) which connect and sustain the arms (1*b*) that swings upwards as demonstrated in FIG. 1.

Both the latter completely open configuration and the intermediate semi-open position illustrated in FIG. 2 of the clothes rack according to the invention are automatically assumed by the rack in that the jointed rods (4) and the jointed struts (6) allow the arms to spread progressively until the rack is completely open, at which point the hinges (5) of the rods (4) and the struts (6) automatically lock, thus guaranteeing the stability of the rack in its final position.

The hinge (5) is composed of two parts (50) and (51). The first bears a wing (52) with U-shaped notch (53) in the centre of its front end, the lateral walls of said notch being parallel and positioned opposite one another but of differeing depths, so that they form a beak (54).

The second part (51) of the hinge (5) is forked and the aforesaid wing (52) may be inserted between its prongs (55) from the sides of which protrude the two-coaxial pivoting pins (56) that can rotate and slide inside their respective slots (57) situated on the two prongs (55).

The hinge (5) is blocked at the limit of its opening span by the aforesaid beak (54) which settles against a transversal plate provided for the purpose between and at the base of the two abovementioned prongs (55); the prongs slide along the pivoting pins (56), subsequent to which said plate automatically fits into the aforementioned notch (53) so that rotation in the opposite direction in order to close the rack can only take place after parts (50) and (51) of the hinge have been moved apart so as to extricate said transversal plate from its niche.

In order to render the design according to the invention versatile to use, the jointed rods that connect and support the various articulated arms are hinged to the transvesal spokes (2) by means of suitable attachments which, when desired, may be rapidly and easily disconnected from said spokes (2), thus enabling the user to adjust the angle of maximum spread between the two adjacent arms according to his or her preferences or requirements.

In the case in point, hinging the rods (4) onto one pair of spokes (2) rather than another brings about a variation in the maximum angle of aperture of the trestle formed by arms (1*a*), in the same way that hinging the struts (6) onto a different spoke (2) lends a different angle of inclination to arms (1*b*) at maximum spread.

The abovementioned hooking devices consist of a cylindrical element (7) moulded in plastic, which is forcibly pushed over the ends of the struts (6) and the rods (4).

The front end of this cylinder (7) takes the form of a collet (7*b*) moulded as a single piece together with the cylinder (7), said collet (7*b*) consisting of a cylindrical ring with an opening in its circumference of sufficient dimensions to allow a spoke (2), circular in section, to be forced inside the ring (7*b*) which, under pressure, bends in an elastic fashion thus opening, and then snaps closed around the spoke (2) inserted therein.

As already mentioned in the introduction, a further prerogative of the design according to the invention is that of being equipped with a peg tray (8) situated between the lateral supporting and pivoting plates (3) of arms (1*a*) and (1*b*), there being provided for this purpose on said plates (3) two notches (3*a*) into which anchoring pins (8*a*) provided on the tray (8) are inserted.

Figure 4:
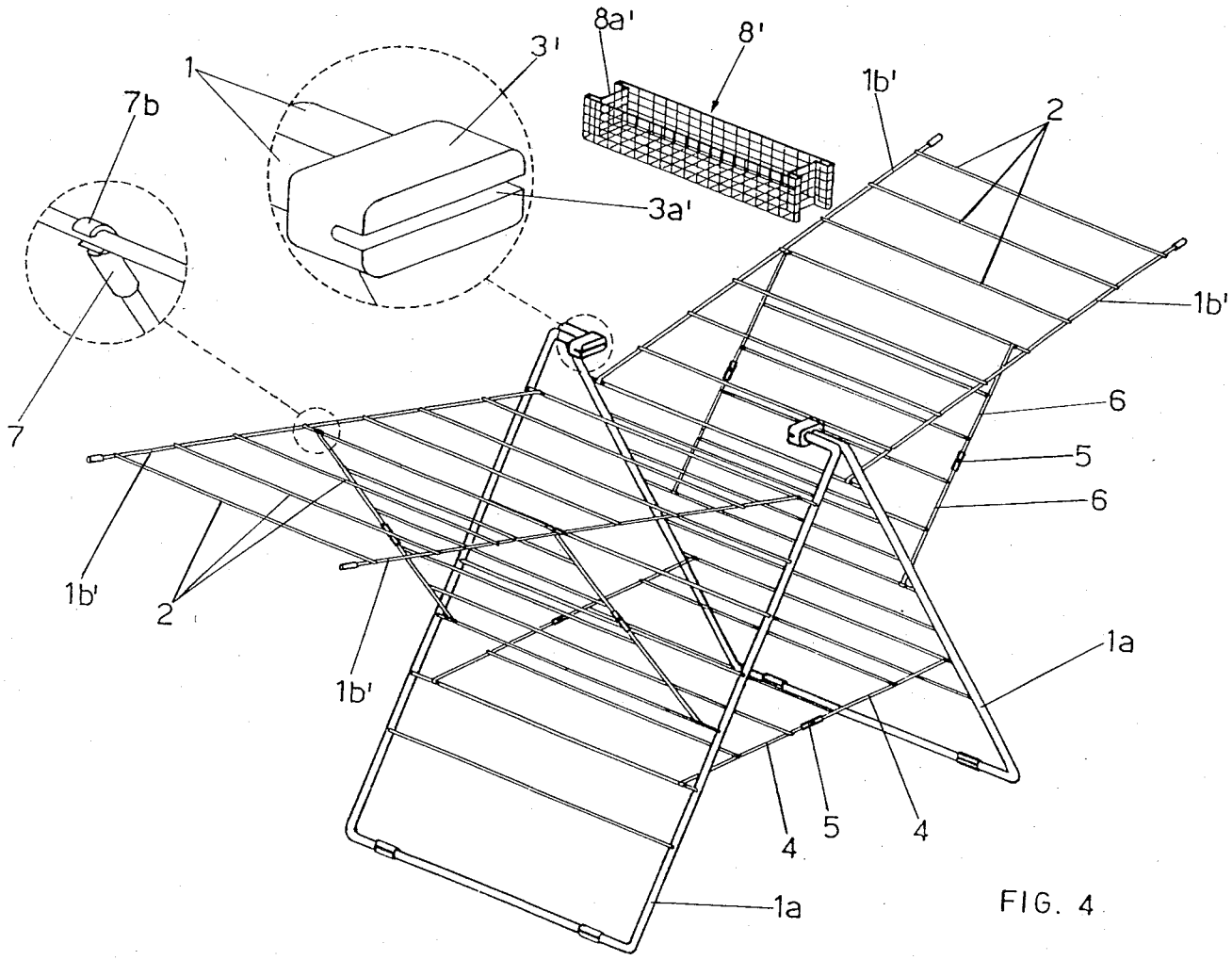
FIG. 4 is an axonometric representation of the clothes rack in position for use according to the invention and according to a further preferred embodiment.

With reference to FIG. 4 it can be seen that in its second preferred embodiment, while the central trestle formed by the two central arms (1*a*) remains unvaried, the design according to the invention does not possess a pair of external arms (1*b*) identical in structure to those numbered (1*a*).

In this version, the external arms consist of two grids (1*b*′) composed of the usual transversal spokes (2) welded onto two lateral supporting rods, one of the ends thereof being hooked, by means of the usual collets (7*b*) onto the highest transversal spoke (2) welded onto arms (1*a*).

Said grids (1*b*′) are sustained by means of centrally jointed struts (6), the latter being hooked onto a spoke (2) of arms (1*a*) at one end, and to a spoke (2) of one of the grids (1*b*′) at the other.

Eliminating arms (1*b*) simplifies the aforementioned plates (3) which merely become two prismatic blocks (3′) on the outside of which no longer four but two holes are made, side by side on a horizontal axis, to accomodate and allow for the pivoting of the end sections (1) of arms (1*a*); on the inner side of said blocks (3′) there is a horizontal groove (3*a*′) into which the edge of the peg tray (8′) is inserted, in which case thelatter, instead of bearing anchoring pins (8*a*), will have an edge in rod iron along with two shaped sections (8*a*′) are provided, designed to couple up with the groove (3*a*′) in the prismatic blocks (3′).

I claim:

1. A domestic clothes rack equipped with a peg tray, said rack comprised of: four arms being articulated in a fan-like fashion, a plurality of rods, each rod bearing a respective central "knee-like" joint, each of the arms including a supporting frame in the form of a portal, two of said arms being vertical supports each of which terminates in two short end sections, each end section being bent inwards at right angles in such a manner as to be exactly opposed and co-axial in relation to one another, a pair of lateral plates situated on parallel vertical planes, each of said plates including an external face having a plurality of holes formed therein, each end section further being housed within the holes inside which they may pivot around a horizontal axis, the plates functioning as the sole means of support and articulation for the four portal shapes frames, the vertical supports acting above all as a supporting and stabilizing trestle, resting on the ground, while the remaining two arms act above all as grids from which to hang washing.

2. A domestic clothes rack equipped with a peg tray, said rack comprised of: four arms being articulated in a fan-like fashion, a plurality of rods, each rod linking a pair of adjacent arms and each rod bearing a respectiv3 central "knee-like" joint hinge, each hinge having two components permitting a maximum angle of articulation of 180° and a minimum angle of articulation of 0° when closed, such that each of the hinges automatically blocks and in order to close it once this position has been assumed it is necessary to move the two hinge components slightly apart, one of the components bearing a wing having a central notch formed therein and a beak being formed on a front end of each wing, while the other of the components bears two prongs within which said wing is anchored each prong having a guiding slot formed therein, a pair of co-axial pins, formed on each wing, each pin protruding from a respective side of said wing, such that each of said pins is received in a respective slot, so that the pins can rotate and slide inside the respective slots provided on the pair of prongs, a transverse plate carried by the prongs exending therebetween, such that as the two components of each joint are moved together the pins slide, within their respective guiding slots, and said plate is received in and locks within the central notch present at the front end of the wing.

3. A domestic clothes rack equipped with a peg tray, said rack comprised of: four arms being articulated in a fan-like fashion, each arm including a plurality of transverse spokes secured onto opposite sides of each arm a plurality of rods, each rod linking a pair of adjacent arms and each rod bearing a respective central "knee-like" joint, and a pair of respective ends having hooks formed thereon, each of said rods being hooked at their ends to the spokes of adjacent arms, said hooks being molded as a single piece, each hook including a cylindrical element having a longitudinal axis, said element being designed to be pushed forcibly over the ends of the rods, each said cylindrical element bearing a collet including a cylindrical ring having a longitudinal axis being perpendicular to the longitudinal axis that of the cylindrical element and further having a circumference having an opening formed therein of sufficient dimensions to allow a spoke to be inserted therein subsequent to the forced opening of the collet which then snaps shut.

4. The domestic clothes rack equipped with a peg tray of claim 1, said rack further comprised of: a plurality of equidistant, parallel spokes are provided, wherein each of the rods link adjacent arms and further wherein a portion of the spokes provides are secured between the rods that link two adjacent arms.

5. The domestic clothes rack equipped with a peg tray, according to claim 1, further comprised of: the peg tray being box-shaped and made in wire net, said peg tray including laterally protruding support pins, each of the lateral plates having slots formed therein and each of the support pins being of such dimensions and positioned in such a manner as to fit into the slots of the plates, said tray fitting precisely between the plates.

6. A domestic clothes rack equipped with a peg tray, said rack comprised of: four arms being articulated in a fan-like fashion, a plurality of rods linking the arms, each rod bearing a respective central "knee-like" joint, two of said arms having a portal shaped supporting frame including two vertical supports, each of which terminates in two short end sections, each of said end sections being bent inwardly at right angles relative to the remainder of the support, so that the end sections of each respective frame are exactly opposed to each other and are co-axial, a pair of prismatic blocks, each of said blocks including an external face having a plurality of holes formed therein, such that said end sections are received within the holes in which they may pivot around a horizontal axis, and, further such that the blocks act as the sole means of support and articulation between the said two arms, at least one pair of struts, each of said two arms being connected to a respective strut, a grid wherefrom washing may be hung, said grid including a plurality of spokes and two lateral supporting rods, said spokes being positioned between and joining the two supporting rods of each grid, thereby forming the grid, each of said struts having at least one end equipped with a collet, so that said end of the strut is hooked-shaped permitting the one end of said struts to be hooked to one of the spokes of the grid.

7. The domestic clothes rack, according to claim 6, further comprised of: a groove being formed on the prismatic blocks, the peg tray having a pair of opposite ends including a peg formed on each end of said tray, each of said pegs being received in a respective groove, whereby the tray is also supported by the blocks.

8. A clothes rack, comprised of:

a pair of vertical supports and a pair of arm supports; each of said vertical supports terminating in a respective pair of end portions, each end portion of each respective pair being bent inwardly towards the other end portion of the same said pair, each end portion of each respective pair further being aligned with the other end portion of the same pair on a respective substantially longitudinal common axis, so that each end portion of each respective pair is coaxial in relation to the other end portion of the same pair;

a pair of substantially parallel mounting plates, each of said mounting plates receiving one of the end portions of each respective vertical support for independent pivotal movement of the vertical supports about the coaxial end portions thereof, the vertical supports being pivotally movable between a closed position, wherein said vertical supports are oriented on substantially parallel planes and an ope position wherein the vertical supports are oriented on substantially intersecting planes; and means for pivotally mounting the arm supports for pivotal movement between a closed position, wherein each arm support is nested on a respective vertical support and an open position, wherein each arm support is spaced from the vertical supports.

9. A clothes rack, comprised of:

a pair of vertical supports and a pair of arm supports;

eachof said vertical supports terminating in a respective pair of end portions, each end portion of each respective pair being bent inwardly towards the other end portion of the same said pair, each end portion of each respective pair further being aligned with the other end portion of the same pair on a respective substantially longitudinal common axis, so that each end portion of each respective pair is coaxial in relation to the other end portion of the same pair;

a pair of substantially parallel mounting plates, each of said mounting plates receiving one of the end portions of each respective vertical support for independent pivotal movement of the vertical supports about the coaxial end portions thereof, the vertical supports being pivotally movable between a closed position, wherein said vertical supports are oriented on substantially parallel planes and an open position wherein the vertical supports are oriented on substantially intersecting planes;

each of the arm supports being pivotally mounted to a respective vertical support;

a space being defined between the parallel mounting plates;

a peg tray having a one end including at least one peg formed thereon and extending outwardly therefrm, and a second end including at least one peg formed thereon and extending outwardly therefrom; and each of the mounting plates having a substantially horizontal groove formed therein such that the pegs on the first and second ends of the peg tray are received in and carried by a respective groove, such that the peg tray is supported by the parallel mounting plates in the space defined therebetween for receiving and storing therein pegs and the like.

10. A clothes rack comprised of:

a pair of vertical supports and a pair of arm supports;

each of said vertical supports terminating in a respective pair of end portions, each end portion of each respective pair being bent inwardly towards the other end portion of the same said pair, each end portion of each respective pair further being aligned with the other end portion of the same pair on a respective substantially longitudinal common axis, so that each end portion of each respective pair is coaxial in relation to the other end portion of the same pair;

a pair of substantially parallel mounting plates, each of said mounting plates receiving one of the end portions of each respective vertical support for independent pivotal movement of the vertical supports about the coaxial end portions thereof, the vertical supports being pivotally movable between a closed position, wherein said vertical supports are oriented on substantially parallel planes and an open position wherein the vertical supports are oriented on substantially intersecting planes;

each of the arm supports being pivotally mounted to a respective vertical support;

a space being defined between the parallel mounting plates;

a peg tray having a one end including at least one peg formed thereon and extending outwardly therefrom, and a second end including at least one peg formed thereon and extending outwardly therefrom;

each of the mounting plates having a substantially horizontal groove formed therein such that the pegs on the first and second ends of the peg tray are received in and carried by a respective groove, such that the peg tray is supported by the parallel mounting plates in the space defined therebetween for receiving and storing therein pegs and the like;

at least one pair of arm support struts, each arm support strut having a respective first end secured to one of the vertical supports and a second opposite end secured to one of the arm supports for retaining and supporting the arm support in the open position and wherein each arm support strut further having a respective joint formed therein between the first and second opposite ends thereof, such that the arm support strut may be pivoted and folded at the joint for moving the respective arm support supported thereby between the open and closed positions;

at least one pair of vertical support struts, each vertical support strut having a respective first end secured to one of the vertical supports and a second opposite end secured to the other of the vertical supports for retaining and supporting the vertical supports in the open position, and wherein each vertical support strut further having a respective joint formed therein between the first and second opposite ends thereof, such that the vertical support strut may be pivoted and folded at the joint for moving the respective vertical supports supported thereby between the open and closed positions;

wherein each joint includes a male portion having a pair of outwardly extending lugs formed thereon and a female portion having a pair of apertures formed therein, such that each aperture receives a respective lug therein for pivotal movement of the male and female portions relative to one another; and wherein each of the joints further includes the female portion having a pair of substantially parallel ears and a slot defined therebetween, each of said ears having one of the respective apertures formed therein, said female portion further having a stop carried by the ears and extending therebetween in the slot, the male portion having a beak portion formed thereon, such that when received in the slot between the ears of the female portion with the lugs received in a respective aperture, the pivotal movement of the male and female portions relative to one another is restricted by contact between the beak of the male portion and the stop carried by the female portion, thereby maintaining the arm supports in the open position.

11. A clothes rack comprised of:

a pair of vertical supports and a pair of arm supports;

each of said supports terminating in a respective pair of end portions, each end portion of each respective pair being bent inwardly towards the other end portion of the same pair, each end portion of each respective pair further being aligned with the other end portion of the same pair an a respective substantially longitudinal axis, so that each end portion of each respective pair is coaxial in relation to the other end portion of the same pair; and a pair of substantially parallel mounting plates, each of said mounting plates receiving one of the end portions of each respective support for independent pivotal movement of each of the supports about the coaxial end portions thereof, the vertical supports being pivotally movable between a closed position, wherein said vertical supports are oriented on substantially parallel planes and an open portion, wherein said vertical supports are oriented on substantially intersecting planes and the arm supports being pivotally movable between a closed position, wherein each arm support is nested on a respective vertical support and an open position, wherein each arm support is spaced from the vertical supports.

12. A clothes rack comprised of:

a pair of vertical supports and a pair of arm supports;

each of said supports terminating in a respective pair of end portions, each end portion of each respective pair being bent inwardly towards the other end portion of the same pair, each end portion of each respective pair further being aligned with the other end portion of the same pair on a respective substantially longitudinal axis, so that each end portion of each respective pair is coaxial in relation to the other end portion of the same pair;

a pair of substantially parallel mounting plates, each of said mounting plates receiving one of the end portions of each respective support for independent pivotal movement of each of the supports about the coaxial end portions thereof, the vertical supports being pivotally movable between a closed position, wherein said vertical supports are oriented on substantially parallel planes and an open portion, wherein said vertical supports are oriented on substantially intersecting planes and the arm supports being pivotally movable between a closed position, wherein each arm support and an open position, wherein each arm support is spaced from the vertical supports;

a space being defined between the parallel mounting plates;

a peg tray having a one end including at least one peg formed thereon and extending outwardly therefrom, and a second end including at least one peg formed thereon and extending outwardly therefrom; and each of the mounting plates having a substantially vertical groove formed therein, such that the pegs on the first and second ends of the peg tray are received in and carried by a respective groove, such that the peg tray is supported by the parallel mounting plates in the space defined therebetween for receiving and storing therein pegs and the like.

13. A clothes rack comprised of:

a pair of vertical supports and a pair of arm supports;

each of said supports terminating in a respective pair of end portions, each end portion of each respective pair being bent inwardly towards the other end portion of he same pair, each end portion of each respective pair further being aligned with the other end portion of he same pair on a respective substantially longitudinal axis, so that each end portion of each respective pair is coaxial in relation to the other end portion of the same pair;

a pair of substantially parallel mounting plates, each of said mounting plates receiving one of pendent pivotal movement of each of the supports about the coaxial end portions thereof, the vertical supports being pivotally movable between a closed position, wherein said vertical supports are oriented on substantially parallel planes and a open portion, wherein said vertical supports are oriented on substantially intersecting planes and the arm supports being pivotally movable between a closed position, wherein each arm support is nested on a respective vertical support and an open position, wherein each arm support is spaced from the vertical supports;

a space being defined between the parallel mounting plates;

a peg tray having a one end including at least one peg formed thereon and extending outwardly therefrom, and a second end including at least one peg formed thereon and extending outwardly therefrom;

each of the mounting plates having a substantially vertical groove formed therein, such that the pegs on the first and second ends of the peg tray are received in and carried by a respective groove, such that the peg tray is supported by the parallel mounting plates in the space defined therebetween for receiving and storing therein pegs and the like;

at least one pair of arm support struts, each arm support strut having a respective first end secured to one of the vertical supports and a second opposite end secured to one of the arm supports for retaining and supporting the arm support in the open position and wherein each arm support strut further having a respective joint formed therein between the first and second opposite ends thereof, such that the arm support strut may be pivoted and folded at the joint for moving respective arm support supported thereby between the open and closed positions;

at least one pair of vertical support struts, each vertical support strut having a respective first end secured to one of the vertical supports and a second opposite end secured to the other of the vertical supports for retaining and supporting the vertical supports in the open position, and wherein each vertical support strut further having a respective joint formed therein between the first and second opposite ends thereof, such that the vertical support strut may be pivoted and folded at the joint for moving the respective vertical supports supported thereby between the open and closed positions;

wherein each joint includes a male portion having a pair of outwardly extending lugs formed thereon and a female portion having a pair of apertures formed therein, such that each aperture receives a respective lug therein for pivotal movement of the male and female portions relative to one another; and wherein each of the joints further includes the female portion having a pair of substantially parallel ears and a slot defined therebetween, each of said ears having one of the respective apertures formed therein, said female portion further having a stop carried by the ears and extending therebetween in the slot, the male portion having a beak portion formed thereon, such that when received in the slot between the ears of the female portion with the lugs received in a respective aperture, the pivotal movement of the male and female portions relative to one another is restricted by contact between the beak of the male portion and the stop carried by the female portion, thereby maintaining the arm supports in the open position.

* * * * *